United States Patent [19]

Anderson, deceased et al.

[11] Patent Number: 4,756,092

[45] Date of Patent: Jul. 12, 1988

[54] METHOD AND APPARATUS FOR DRYING SLUDGE

[75] Inventors: Charles M. Anderson, deceased, late of Dillard, Ga., by Joyce A. Anderson, executrix; Wayne Anderson, Marietta, Ga.

[73] Assignee: Habersham Environmental Products, Ga.

[21] Appl. No.: 905,921

[22] Filed: Sep. 10, 1986

[51] Int. Cl.[4] ..... F26B 3/20

[52] U.S. Cl. ..... 34/17; 34/39; 34/40; 34/182; 34/183

[58] Field of Search ..... 34/68, 180, 181, 17, 34/39, 40, 182, 183; 110/227, 224, 254; 432/140, 144, 202, 207, 209, 147, 148

[56] References Cited

U.S. PATENT DOCUMENTS 3,744,145 7/1973 Maxwell et al. ..... 110/227

*Primary Examiner*—L. I. Schwartz

*Attorney, Agent, or Firm*—Jones, Askew & Lunsford

[57] ABSTRACT

An apparatus and method for removing water from sludge waste material is provided. A layer of sludge is disposed upon an endless screen belt which is in turn dragged across a heated plate such that water in the sludge is evaporated and escapes from the sludge as steam. The endless screen is formed by a chain link belt which provides a plurality of discrete containers for small volumes of the sludge. The sludge may also be preheated just prior to drying by the injection of hot air columns into the sludge, such that the sludge is heated and agitated. The steam escaping from the drying sludge is directed into a heat exchanger which in turn heats the preheating air. Waste gases from a heating station are returned to the burner at the heating station to oxidize foul smelling chemicals and then reduce the odors generated by a sludge drying operation. If it is desired to retain some of the proteins in the sludge, the temperature of the heated plate is regulated such that the temperature if the sludge is not raised above approximately 256 degrees Fahrenheit, which is the point at which many proteins are effectively destroyed.

21 Claims, 3 Drawing Sheets

METHOD AND APPARATUS FOR DRYING SLUDGE

TECHNICAL FIELD

The present invention generally relates to sludge drying systems and particularly relates to such systems which include a mesh-like conveying belt which carries sludge across a heated plate.

BACKGROUND OF THE INVENTION

The handling of organic sludge materials, such as residential or commercial sewage, or animal slaughterhouse refuse, has lately become a matter of great public concern, as the disposal sites for such materials are limited in supply and capacity. Furthermore, such waste materials have been found to pose safety or health hazards if not properly handled and disposed.

As it is not uncommon to encounter waste materials which include up to 94% water by weight, it has been found advantageous to extract as much water from the waste materials as possible in order to reduce later handling and disposal costs. However, a trade-off has been recognized between the savings in handling and disposal costs, and the cost of removing the water from the waste.

Various prior art methods and apparatus for the removal of water from solid sludge material have been utilized. One type of apparatus mechanically separates water from solid waste by the use of a rotating drum having a filtering screen about its circumferential surface. Waste is inserted inside the drum, and the drum is rotated such that centrifugal force drives the waste material through the filtering screen, which preferably retains the solids and allows the water to pass. A second type of mechanical separation is by use of a mechanical press which forces waste material against a filtering screen, which likewise preferably retains the solids and allows the water to pass. Yet another type of water removal is by natural evaporation, which is usually done by placing the sludge in large drying pools which are exposed to sunlight. The water evaporates from the sludge, and the solid wastes are left behind.

However, these prior art apparatus and methods are both inefficient and time-consuming. The previously-mentioned mechanical separation methods include the use of large and expensive machinery, which is expensive to operate and maintain. These machines may not be continuously operated, and may have significant down times during cleaning. Furthermore, it is possible that the filtered water may still include some contaminate. The natural evaporation method, although requiring little operating machinery, requires a large amount of space, and is a very time-consuming project, often taking several weeks.

It has been known to provide apparatuses which heat moisture-laden waste materials in order to encourage evaporation of water from the waste. U.S. Pat. No. 3,744,145 to Maxwell is an example of such an apparatus. Maxwell discloses the use of a plurality of parallel troughs which accept waste material. A plurality of corresponding fingers are movable within the troughs which push the waste material along the troughs. The troughs are heated in order to dry the waste material.

Although the use of heat is effective in drying waste materials, the heating process must be closely monitored if it is preferred to use the waste material for fertilization purposes, as heat tends to destroy preferably proteins in the waste material. It should be understood that in the Maxwell apparatus, this was not a concern as Maxwell disclosed the use of an incinerator at the exit end of the dryer which burned the waste materials.

Therefore it may be seen that there is a need for an apparatus or method which removes moisture from sludge materials in a time- and cost-effective manner, without destroying desirable proteins in the sludge.

SUMMARY OF THE INVENTION

The apparatus and method of the present invention solves problems in the prior art by providing a means for reducing the moisture content of a waste material in an inexpensive and time-efficient manner. The initial cost of the apparatus is comparable to conventional apparatuses, but great savings are realized in operating costs.

From the following description of the preferred embodiment it will be appreciated that the present invention has considerable utility for drying all forms of sludge, but that the invention was developed primarily for purposes of drying sludge which results from modern commercial food processing, which sludge contains significant amounts of nutrients.

As it is known by those skilled in the art, some food processing sludge contains significant quantities of protein. In the environment of a food processing plant, it is often desirable to dry the sludge to the maximum extent possible, without destroying the protein content of the dried sludge. When this operation is successfully performed, the dried sludge can be recycled as animal feed.

Of course, sludge can be further dried, so that its water content is reduced to even lower levels, but this is normally at the expense of the protein content of the dried sludge product.

Generally described, the present invention includes both an improved method and apparatus for drying sludge, and in particular sludge resulting from a commercial food processing plant operation. According to one aspect of the present invention, the sludge is moved through one or more preheating zones and over a heated plate by a screen belt having a particular geometry in cross-sections both parallel to and orthogonal to the plane of the heated plate. In its preferred form, the improved screen belt used in the present invention includes a plurality of discrete chambers, or holes, having metallic vertical side walls. This causes the sludge deposited on the belt to be contained in a large number of discrete chambers bounded by the metallic side walls of the screen belt. This in turn gives the operator of the present invention greater control over the drying process since an understanding of how the process is conducted within each discrete hole of the mesh of the screen belt determines the overall drying process for the entire plant. It should be understood that as the screen belt is dragged over the heating plate, the metallic vertical side walls of the screen plate mesh are also heated. This provides a significant drying improvement over prior art apparatus using direct heating.

According to another aspect of the present invention, maximum use of heat generated within the sludge drying apparatus is made by recirculating heated air back to preheating zones within the apparatus. The provides a considerable improvement in overall efficiency of the apparatus, as compared to the prior art.

According to yet another aspect of the present invention, a gaseous output of the sludge from the direct heating zone, which contains significant quantities of chemicals which produce noxious odors, is recirculated throughout the apparatus and injected directly back to a burner station which is used to heat the above-referenced plate. Thus, a significant percentage of the chemicals in the waste air, which come off of the heating station in the sludge drying apparatus, is burned and thoroughly oxidized, thus significantly reducing the overall level of obnoxious odors eminating from a sludge drying apparatus. According to a preferred form of this portion of the present invention, the recirculation path for the waste gases includes a condenser and a trap for condensing steam contained in the waste gas, and removing same from the drying apparatus so that the gas reinjected at the burner station does not contained too much water, thus adversely affecting the operation of the burner.

In its preferred form, the apparatus of the present invention includes a generally planar plate upon which the sludge will be carried. An endless screen belt assembly, having cross-sectional geometries of the type described above, is constantly urged along the plate. The apparatus includes means for depositing sludge which is input to the apparatus onto the screen at a controlled rate. The sludge carried by the discrete sections of the screen belt is dragged through one or more preheating zones and over a heating station at which the plate is directly heated, preferably by gas burning apparatus.

According to a preferred form of the present invention the sludge is elevated to a temperature within a particular temperature range prior to arriving at the heating station to maximize the effectiveness of the drying step. According to a preferred form of the present invention, an optimal trade-off between the reduction of the water content of the sludge and the retention of protein content of the sludge is obtained by controlling both the temperature of the sludge as it leaves the preheating zone and the amount of heat applied to it at the heating station.

According to yet another aspect of the present invention, preheated air is injected directly to the sludge at the preheating station by means of jets disposed above the above-referenced plate. In the preferred form of the present invention, the effects of this air injection are carefully controlled because the sludge is effectively treated as a large number of individual pools defined by the above-described mesh elements of the screen belt.

It is an object of the present invention to provide an improved method and apparatus for reducing the water content of a waste material.

It is a further object of the present invention to provide such an apparatus which is inexpensive to obtain, operate, and maintain.

It is a further object of the present invention to provide such an apparatus and method which reduces the water content of an organic waste material, with minimum protein loss.

It is a further object of the present invention to provide an improved sludge drying apparatus which maximizes the internal use of heat generated by the apparatus in order to improve overall efficiency and reduce the cost of operation.

It is still a further object of the present invention to provide an improved method and apparatus for sludge drying which significantly reduces the output of gases which cause obnoxious odors to the operators of the apparatus and other people in the vicinity of the sludge drying equipment.

It is still a further object of the present invention to provide an improved sludge drying apparatus which may be operated for longer periods of time between shut-down and cleaning, as compared to prior art apparatus. In this respect, it is also an object of the present invention to provide sludge drying apparatus in which the mechanical carrier for the sludge through the apparatus is substantially self-cleaning during operation.

Other objects, features, and advantages of the present invention will become apparent upon reading the following detailed description in conjunction with the drawings and the claims.

DESCRIPTION OF THE DISCLOSED EMBODIMENT

Figure 1:
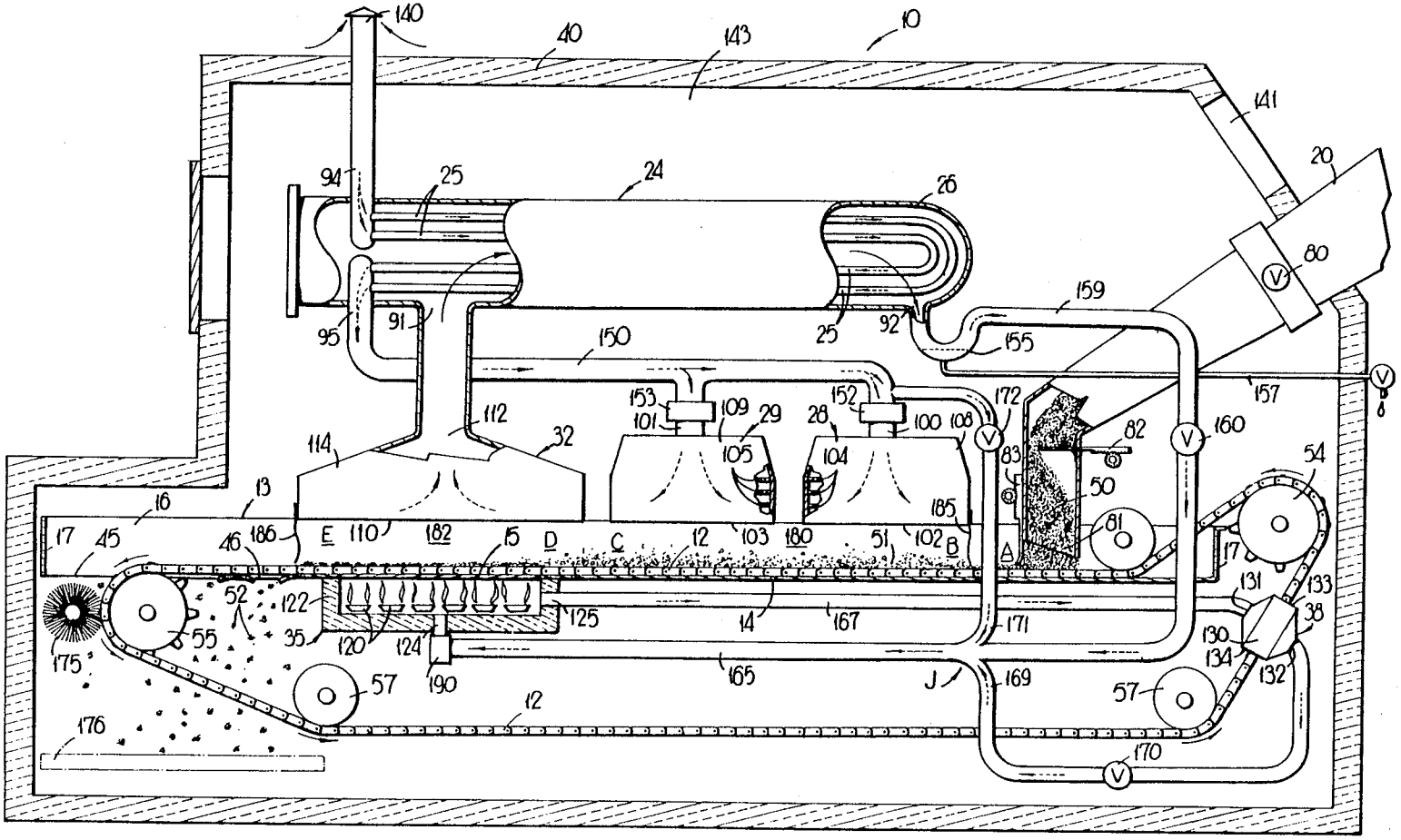
FIG. 1 is a diagrammatic side view of the sludge drying apparatus of the present invention.

Referring now in detail to the drawings, in which like numerals represent like parts throughout the several views, FIG. 1 shows the drying apparatus 10 of the present invention. The apparatus 10 generally includes an endless screen belt 12, a channel 13 having a floor 14, an input chute 20, a heat exchanger 24, two preheating hoods 28, 29, a steam hood 32, a heating assembly 35, a belt preheating assembly 38, and an enclosure 40. A heated plate 15, being part of the heating assembly 35, is provided in a similarly-shaped opening in the channel floor 14, such that the upper surface of the heated plate is substantially coplanar with the upper surface of the channel floor.

For purposes of effective description, a summary discussion of the operation of the drying apparatus 10 is now described. Sludge 50 is disposed into a sludge layer 51 into the screen belt 12, which is in sliding contact with the upper surface of the channel floor 14 as well as the heated plate 15. As the sludge 50 is disposed into the belt 12, the sludge flows through holes in the belt and contacts the upper surface of the channel floor 14. As the belt 12 drags across the upper surface of the channel floor 14, the sludge layer 51 is similarly dragged along the upper surface of the channel floor by the screen belt 12. The sludge layer 51 is first preheated from above by air from the preheating hoods 28, 29, and subsequently heated from below to a higher temperature while passing over the heated plate 15. These heating processes elevate the temperature of the sludge layer 51 such that water in the sludge is vaporized and escapes as steam. The dried sludge 52 is then removed from the screen belt 12 and the drying apparatus 10, and is then in a much more managable form, which may be readily transported from the drying apparatus site in conventional open-topped carriers such as dump trucks, instead of the previously-required tankers. A belt preheating assembly 38 is provided which directs exhaust gases from the heating assembly 35 toward the belt 12.

Figure 2:
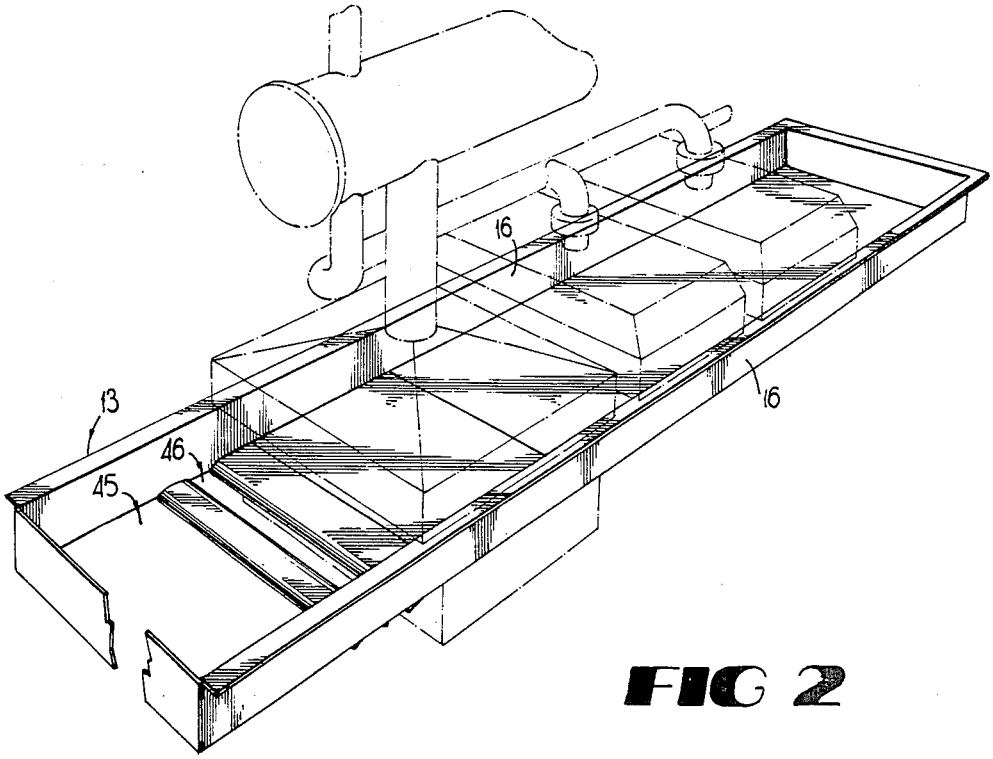
FIG. 2 is an isolated, partially cut away pictorial view of the channel 13 of the present invention, with the burner assembly, preheating hoods, a portion of the heat exchanger, and associated tubing shown in phantom.

Referring to FIGS. 1 and 2, the channel 13 includes a channel floor 14, as previously discussed, and also includes two vertical side walls 16 and two end walls 17. As previously discussed, the sludge layer 51 is dragged along a major portion of the length of the channel 13. Therefore it may be understood that the channel 13 includes a leading end and a trailing end. At the trailing edge of the channel 13, a first opening 45 extending completely through the channel floor 14 is provided to allow passage of the belt 12. A second opening 46 is provided just upstream from the first opening 45 to allow the dried sludge 51 to fall from the belt 12. The heated plate 15 is located just upstream of the second opening 46 and fits within a similarly shaped opening extending through the channel floor 14. As previously discussed, the upper surface of the heated plate 15 is substantially coplanar with the channel floor 14. However, a small layer of insulative material is provided about the peripheral edges of the heated plate 15 between the heated plate and the channel floor 14, to allow the heated plate to expand and contract, and also to discourage heat transfer from the heated plate to the channel floor.

The channel 13 is sloped slightly downward from the leading edge to the trailing edge, to facilitate effective flow of the sludge.

The belt 12 is an endless screen belt which is driven in continuous sliding contact with the upper surface of the channel floor 14 and the heated plate 15 by means of a drive sprocket 54, an idler sprocket 55, and idler rollers 57. The width of the belt 12 is substantially uniform, and is such that the belt fits just within the two side walls 16 of the channel 13 without binding.

Figure 3:
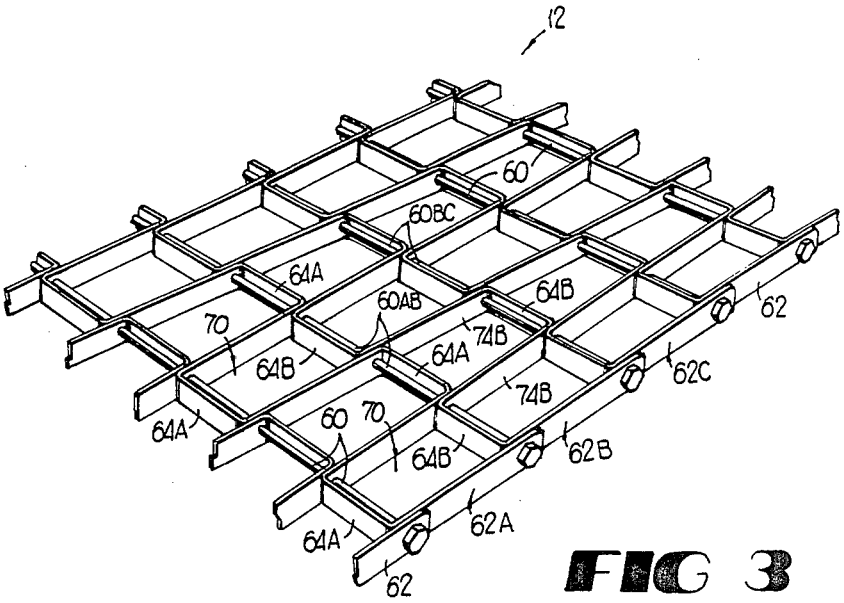
FIG. 3 is a pictorial view of a portion of the screen belt 12.
Figure 4:
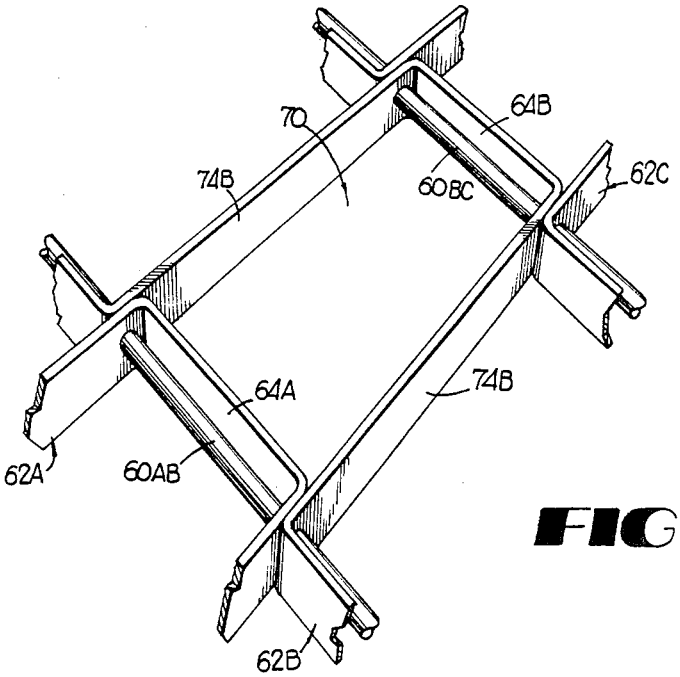
FIG. 4 is an isolated pictorial view of one of the holes 70 defined by the screen belt 12.

Referring now to FIGS. 3 and 4, the particular configuration of the belt 12 in the preferred embodiment is now described. The belt 12 is configured similar to "type A" belts manufactured by Ashworth Bros., Inc., of Winchester, Va., and Salinas, Calif. In Ashworth Bulletin FW77, copyright 1968. Said Ashworth Bulletin FW77 is heavily incorporated by reference. The belt 12 includes a plurality of similarly-shaped elongate rods 60 and a plurality of similar serpentine-shaped strips 62. The rods 60 have similar circular cross sections and similar lengths, and extend across the width of the belt 12 such that their longitudinal axes are substantially mutually parallel. The serpentine strips 62 have a rectangular transverse cross-section having a pair of opposing major edges and a pair of opposing minor edges. It may be seen that the length of the opposing major edges defines the "thickness" of the belt 12. The serpentine strips 62, while having a generally serpentine shape, do not include well rounded bends, but have relatively "squared-off" bends.

For purposes of explanation of the interaction of the serpentine strips and the rods, three adjacent serpentine strips shown in FIG. 2 are now denoted as 62A, 62B, and 62C. Likewise, two adjacent rods 60 which link the serpentine strips 62A, 62B, and 62C together are now denoted as 60AB and 60BC. Strip 62A is in a nesting relationship relative to strip 62B such that the truncated crest portions 64B of strip 62B fit within corresponding mouths defined by strip 62A. It may seen that the strips 62A, 62B do not completely nest together, but a series of trapezoidal gaps or holes 70 is left between the strips 62A, 62B. The strips 62A, 62B, are linked together by rod 60AB, which fits through openings (not shown) defined by the strips 62A, 62B. It should be understood that the rod 60AB rotatably fits within the openings in the serpentine strips 62A, 62B, such that the serpentine strips each may pivot about the rod 60AB, and therefore the strips may pivot relative to each other about an axis common to the longitudinal axis of the rod 60AB.

It should be understood that strips 62B, 62C, cooperate and are linked together by rod 60BC in a manner similar to that described above in reference to strips 62A, 62B, and rod 60AB.

Referring now to FIG. 4, a typical hole 70 in screen belt 12 defined by strips 62A and 62B is shown. It may be seen that the hole 70 is defined at one end by the truncated crest portion 64A of strip 62A, at two sides by angled portions 74B of strip 62B, and at the other end by truncated crest portion 64B of strip 62B.

As previously discussed, the serpentine strips 62 have a substantially rectangular cross section. When the belt is in contact with the upper surface of the channel floor 14, it may be seen that one edge of the serpentine strip 62 is flat against the plate. During operation of the drying apparatus when the belt 12 is dragged across the channel floor 14 and the heated plate 15, the belt thus provides a "scraping" function which discourages the sludge from adhering to the channel floor or the heated plate. The rods 60 do not touch the channel floor 14 or heated plate 15.

Referring now to FIG. 1, the input chute 20 has one end operably associated to a hopper (not shown) and includes a butterfly valve 80, an outlet opening 81, a flow metering assembly 82, and a thickness metering assembly 83. The input chute 20 functions to dispose sludge 50 upon the leading edge of the channel floor 14 in a sludge layer 51 such that the sludge may be dragged along the upper surface of the channel floor 14 by the belt 12. The flow metering assembly 82 includes a plate which may be extended or retracted within the chute 20 to meter the flow of sludge through the chute. The thickness metering assembly 83 includes a plate which may be raised and lowered to allow a "layer" of sludge 50 of selected thickness to be disposed upon the channel floor 14 and belt 12.

The heat exchanger 24 is a type HCF 08-042, 1 pass heat exchanger as manufactured by American Standard, and includes a shell 26 having an inlet port 91 and an outlet port 92, and also includes internal tubing 25 having an inlet manifold 94 and an exhaust manifold 95. It should be understood that the heat exchanger 24 is of a typical shell-tubing configuration which allows heat to be transferred from one fluid to the other without physical intermixing of the fluids. In this particular situation, fluid passing through the tubing 25 from the inlet manifold 93 to the exhaust manifold 94 is heated by fluid contained in the shell 26.

The preheating hoods 28, 29, are both similar and are type Cryo-Jet hoods as manufactured by HECO Products, Coppell, Tex., and are positioned above the channel floor 14, with preheating hood 28 being on the leading side of preheating hood 29. The preheating hoods 28, 29, have inlet ports 100, 101, respectively, and outlet ports 102, 103, respectively. The outlet ports 102, 103, are downwardly directed toward the upper surface of the channel floor 14.

Figure 5:
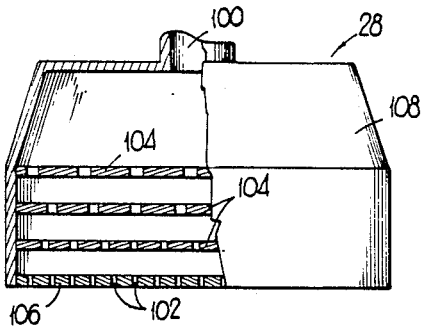
FIG. 5 is an isolated partially cutaway plan view of one of the preheating hoods 28.
Figure 6:
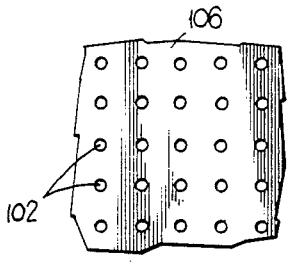
FIG. 6 is an isolated lower plan view of the outlet plate of the one of the preheating hoods 28, showing the outlet ports 102.

Referring now to FIG. 5, the particular configuration of preheating hood 28 is discussed. Preheating hood 28 includes an inlet port 100, as previously discussed, and also includes a plurality of baffle plates 104, an outlet plate 106 defining the outlet ports 102, and a cover 108. The baffle plates 104 and the outlet plate 106 have primary planar surfaces which are substantially mutually parallel.

The preheating hood 28 is configured to accept a flow of fluid under pressure (typically air) in the inlet port 100 and disperse the air in individual parallel "columns" of air out of corresponding outlet ports 102. The baffle plates 104 serve to disperse the air as it passes through the preheating hood 28 such that the air pressure is relatively consistent across the transverse cross section of the preheating hood, and such that the air exits the outlet ports 102 in a substantially uniform manner.

As the preheating hoods 28, 29, are substantially similar in configuration, it should be understood that the preheating hood 29 has a correspondingly similar set of baffle plates 105, an outlet plate (not shown) and a cover 109.

Referring now again to FIG. 1, the steam hood 32 includes a steam-accepting mouth 110, an outlet port 112, and a cover 114. As discussed in detail later, the steam hood 32 draws away steam from the sludge and air from the preheating hoods through the steam-accepting mouth 110 and directs the steam-air mixture into the shell 26 of the heat exchanger 24.

The heating assembly 35 includes the heated plate 15, positioned as previously discussed, and includes a plurality of gas burners 120, and an enclosure 122 having an air inlet port 124, a gas inlet port (not shown), and an exhaust port 125. The burners 120 are positioned such that when ignited, they heat the heated plate 15. The air inlet port 124 is configured to accept air having an oxygen content suitable to allow gas supplied to the gas burners 120 to combust. The exhaust port 125 is configured to vent the products of the combustive reaction.

The belt preheating assembly 38 is configured to direct a flow of hot exhaust gases from the heating assembly 35 toward the belt 12. The belt preheating assembly 38 includes a cavity 130 defining opposing air inlet and outlet ports 131, 132, and opposing belt inlet and outlet slots 133, 134, respectively. The belt preheating assembly 38 is configured such that the belt 12 may pass through the cavity 130 by means of belt inlet and outlet slots 133 and 134, and such that hot gases provided into the air inlet port 131 are directed toward the belt 12, and then exhausted through air outlet slot 134. Of course, it should be understood that some air will leak out of the belt inlet and outlet slots 133 and 134, as a perfect seal is neither necessary nor practical.

The outer enclosure 40 of the drying apparatus 10 is thermally insulated, and includes an inlet stack 140, and a one-way relief port 141. The outer enclosure 40 defines an interior cavity 143.

As previously discussed, various elements of the drying apparatus 10 are operably linked such that air or sludge may be transported from one element to another. Such interaction is now discussed, somewhat in reference to the path of travel of the air or sludge.

The air inlet stack 140 is tubular, and has a first end open to the air outside of the enclosure 40 of the drying apparatus 10, or "ambient" air. The air inlet stack 140 has a second end in mating contact with the inlet manifold 93 of the heat exchanger 24 so as to allow ambient air to flow from the exterior of the drying apparatus 10 to the tubing 25 of the heat exchanger 24.

The outlet manifold 94 of the heat exchanger 24 is linked for air communication with the inlet ports 100, 101, of the preheating hoods 28, 29, respectively, by means of piping 150. Fans 152, 153, are provided intermediate the piping 150 and the preheating hoods 28, 29, respectively, such that air may be drawn from the exterior of the drying apparatus 10 through the heat exchanger 24, the piping 150, and into the preheating hoods and also through the fan 190 which leads to the heating assembly 35.

The outlet port 112 of the steam hood 32 is linked for air communication with the inlet port 91 of the shell 26 of the heat exchanger 24. The outlet port of the shell 26 of the heat exchanger 24 is linked for air communication with a P-trap 155, which allows water which has condensed within the shell 26 of the heat exchanger to be drawn of through water line 157, while the remaining air passes through the P-trap.

The outlet end of the P-trap 155 is linked for air communication with piping 159 including a intermediate flow restriction valve 160. Piping 160 allows fluid communication from the heat exchanger 24 to junction point J, at which point the piping 159 merges with piping 169 and piping 171 (discussed in detail later) which all connect to piping 165, which leads to the air inlet port 124 of the heating assembly 35. The exhaust port 125 of the heating assembly 35 is linked via piping 167 to the air inlet port 131 of the belt preheating assembly 38. The air outlet port 132 of the belt preheating assembly 38 is linked to piping 169, which leads to the previously discussed junction point J and is linked to piping 165. Piping 169 includes an intermediate flow restriction valve 170.

As previously discussed, piping 150 leads from the heat exchanger 24 to the preheating hoods 28, 29. Furthermore, piping 171 leads from piping 150 to the previously discussed junction point J and is linked to piping 165. Piping 171 also includes an intermediate flow restriction valve 172.

Operation of the apparatus is now described. The belt 12 is driven by the drive sprocket 54 and the idler sprocket 55, such that the belt is dragged across the channel floor 14 and the heated plate 15. The liquid sludge 50 is disposed onto the belt 12 by the inlet chute 20 at what will now be referred to as point "A". The metering plate assembly 83 at the exit end of the inlet chute 20 spreads the sludge 50 across the moving belt 12 into a sludge layer 51 having a relatively constant thickness.

As the belt 12 carries the sludge layer 51 along the channel floor 14 and heated plate 15, the sludge encounters the leading edge of the first preheating hood 28 at point "B". As previously discussed, the preheating hoods 28, 29, include a plurality of downwardly-disposed outlet ports 102, 103, respectively. Air is forced out of the outlet ports 102, 103, by fans or other means known in the art at a relatively high pressure in what may be considered "columns" of air. As the sludge layer 51 encounters the preheating hoods 28, 29, these columns of air are forced out of the hoods at such high pressure that the preheated air is not only blown onto the top surface of the sludge layer, but is also injected into the layer, although the preheating hoods 28, 29, do not contact the sludge layer 51. As the columns of air pass through the sludge layer 51, they encounter the channel floor 12 and are then deflected upwardly and outwardly, such that the sludge is thoroughly churned and agitated, and a portion, although not all, of the air is retained by the sludge. The significance of this injection and agitation step will be discussed later.

As the sludge layer 51 passes under the preheating hoods 28, 29, it should be understood that the air, which has been previously heated by the heat exchanger 24, transfers heat to the sludge, thus "preheating" it. At point "C", being the trailing edge of preheating hood 29, the sludge should be at approximately the same temperature as the air discharged by the preheating hoods 28, 29.

At point "D", being just downstream of point "C", the sludge layer 51 encounters the leading edge of the heated plate 15. At this point the sludge is heated such that a portion of water in the sludge layer is evaporated, and escapes upwardly as steam.

At point "E", being the rearmost edge of the heated plate, the sludge layer 51 emerges from beneath the steam hood 32 in the requisite "dry" state, now referred to as dried sludge 52. At this point the dried sludge 52 is dragged over the opening 46 in the channel floor 14, and a portion of the dried sludge 52 falls under the influence of gravity from the belt 12 and through the opening. The portion of the sludge 52 which does not fall from the belt 12 is "poked" out of the holes 70 in the belt by the idler sprocket 55, which defines a plurality of nubs which matingly fit within corresponding holes in the belt. Remaining dried sludge 52 which is stuck to the belt 12 is dislodged from the belt by a rotating cleaning brush 175 positioned adjacent to the idler sprocket 55. The dried sludge 52 falls onto a conveyer 176, or a chute, hopper, or similar device, and is then removed from the drying apparatus 10.

As previously discussed, during drying of the sludge layer 51, water escapes in the form of steam, which is captured by the steam hood 32. Also as previously discussed, the outlet port 112 of the steam hood 32 is linked to the inlet port 91 of the shell 26 of the heat exchanger 24. As the heated steam passes through the heat exchanger 24, it may be seen that the heat is transferred from the steam to the tubing 25, which likewise transfers heat to air within the tubing, which, as previously discussed, was drawn in from the exterior of the drying apparatus 10 at ambient temperature and atmospheric pressure. It may therefore be seen that heat from the steam is used to preheat air which is to be supplied to the preheating hoods 28, 29.

Also as previously discussed, air and sludge which pass through the drying apparatus 10 are raised to various elevated temperatures. Typical desired temperatures of the air and sludge will now be discussed, although it is not necessary that these temperatures be reached in order to practice the invention.

Air drawn in through the inlet stack 140 is at ambient temperature (typically 65–90 degrees Fahrenheit). As the air is drawn into the internal tubing 25 of the heat exchanger 24, it is heated by steam, as previously discussed, to an elevated temperature, preferably 180–190 degrees Fahrenheit. The air is then drawn into the preheating hoods 28, 29. Should the temperature of the air not be at the required temperature when it reaches the preheating hoods, heaters (not shown) on the intake side of the hoods are activated to heat the air as desired. The air then is directed through the preheating hoods 28, 29, and exits the hoods as individual air columns. As previously discussed, the air is then essentially injected into the sludge as it passes underneath the preheating hoods 28, 29 thus "preheating" and agitating the sludge layer in a preheating zone 180 (FIG. 1), which is essentially between previously-discussed points "B" and "C". The sludge layer 51 is preferably preheated to a temperature approximating the temperature of the air columns.

After the sludge is preheated, it passes into a drying zone 182, which is essentially between previously-discussed points "D" and "E" along the path of travel of the sludge layer 51. In the drying zone 182 the sludge layer is heated from below by the heated plate 15. As previously discussed, steam escapes from the sludge and is drawn through the steam hood 32 and then into the shell 26 of the heat exchanger 24. The drying zone 182 and the preheating zone 180 are isolated from the interior cavity 143 of the drying apparatus 10 by the side walls 16 extending from the sides of the channel floor 14, and also by front and rear end flaps 185, 186. Therefore it may be seen that the steam hood 32 accepts steam from the drying zone 182 as well as air from the preheating zone 180 exhausted by the preheating hoods 28, 29, which was injected into but not absorbed by the sludge. As this steam-air mixture will be slightly odorous due to intimate contact with the sludge, it will now be referred to as "odorous gas".

The odorous gas from the dried sludge 52 enters the inlet port 91 of the heat exchanger 24 is at approximately 256 degrees Fahrenheit. As previously discussed, heat is transferred from the steam to the tubing 25 of the heat exchanger. Therefore, some amount of liquid condensate will form in the shell 26 of the heat exchanger 24. The condensate liquid and remaining odorous gases are then directed out the outlet port 92 of the shell 26 of the heat exchanger 24, and then into the P-trap 155, which separates the condensate into the water line 157, and allows the remaining odorous gases to pass into piping 159, which leads to junction point J, as previously discussed. The odorous gases are then mixed with other gases supplied by piping 169 and 171, and the resulting mixture passes via piping 165, past a fan 190, and into the air inlet port 124 of the heating assembly 35, to provide oxygen to the burners 120. The exhaust gases from the combustive reaction are then routed to the belt preheating assembly 38, and then returned to junction point J via piping 169.

Therefore it may be seen that the odorous gases from piping 159, "fresh" air from piping 171, and exhaust gases from piping 169 are all combined at junction point "J", and then drawn through piping 165 by fan 190 into the heating assembly 35 to be burned. The percentage of flow drawn from each of the piping lines 159, 169, 171, may be gauged by adjusting corresponding flow restriction valves 160, 170, 172.

It may be seen that by burning odorous gases from piping 159, the odor of gases emitted from the drying apparatus is reduced. It may also be seen that by mixing some of the exhaust gases from piping 169, the temperature of the resulting mixture is raised, therefore improving the efficiency of the combustion process. However, too much exhaust gases may not be provided into piping 165, as the exhaust gases tend to have a low oxygen content. A typical mixture used by the inventors is a 35% flow contribution by volume of odorous gases from piping 159, 45% flow contribution of exhaust gases from piping 169, and 20% flow contribution of fresh air from piping 171, although other mixtures may be used without departing from the spirit and scope of the present invention.

It should be understood that just as fresh air is drawn into the drying apparatus 10, so must some gases escape through the relief port 141. These gases will escape from various inner elements of the apparatus, most markedly through the belt inlet and outlet slots 133, 134, respectively, and also past the front and rear end flaps 185, 186.

Therefore it may be seen that the sludge 50 undergoes several stages of treatment throughout its passage through the drying apparatus 10. At this point the particular property changes of the sludge during each stage of treatment will be discussed.

At point A, the temperature of the sludge 50 is just above "ambient" temperature, which may be between 60 and 90 degrees Fahrenheit. The temperature is just above ambient temperature as the sludge has been slightly heated due to the belt 12 being preheated by the belt preheating assembly 38.

At point B, the sludge layer 51 is impinged by the heated air columns discharged from the preheating hoods 28 which are at preferably 180–190 degrees.

The water has been previously treated with ferric chloride and an electrolytic polymer. The presence of these materials make anything that is a solid, such as a protein, coagulate, that is, bond together, such that the sludge may be separated from water in the pretreatment process. As the air from the preheating hoods 28, 29, contacts the sludge, the coagulative effect again occurs, and the water in the sludge material goes to the top of the layer, and the solids go to the bottom. This is a disadvantageous effect, as is is desired to have as much water at the bottom of the layer as possible, so that the water will be effectively evaporated in the following steps. However, as the air is continuously injected into the sludge layer 51 as previously discussed, the sludge retains some of the air, and thus "fluffs" up and floats to the top of the sludge layer, which is an advantageous effect.

As the sludge layer reaches point "C", the temperature of the sludge should have been raised to at least 180 degrees Fahrenheit, which is the point at which optimum coagulation results. At this point, more air and less water will be in the sludge as compared to point "A", as the sludge will have retained some of the air, and lost some water due to evaporation.

At point "D", the sludge layer 51 is heated to a further elevated temperature such that water in the sludge layer 51 is evaporated from the sludge, thus producing dried sludge 52.

Obviously, it is desired to remove as much water by evaporation as is practical. However, it has been found by the inventors that the weight percent of solids obtained in the final product is inversely proportional to the amount of proteins retained, as the protein tends to "flash" when raised to a certain temperature. For purposes of this application, flashing is referred to as the destruction of organic material by heat. Therefore, if it is desired to retain an amount of protein in the dried sludge 52, the temperature of the sludge layer should be carefully regulated in order to prevent excessive flashing of the protein.

It has been found by the inventors that an application of heat by the heated plate 15 such that the sludge is gradually raised from 180 degrees to not greater than 256 degrees Fahrenheit as the sludge passes across the belt produces sludge having approximately 35–45 weight percent solids with an acceptable protein content. An acceptable protein content is generally understood in the industry as being approximately 50% of the original protein content. This end product is a relatively stable mass which may be handled with conventional solid disposal equipment.

If it is not desired to retain the protein content of the dried sludge 51, the temperature of the sludge layer 51 may be raised above 256 degrees for as long as is practicable. Tests by the inventors have determined that a dried product having approximately 95 weight percent solids may be obtained, although with a negligible protein content.

At point "E", the dried sludge 52 is removed from the belt 12 as previously discussed, and conveyed from the drying apparatus by conveyor 176.

The thickness of the sludge layer will vary as it passes through drying apparatus 10. In one test by the inventors, a layer of ½" thickness was provided at point A. At point C, the sludge layer 51 had been "fluffed up" to a 2 inch thickness. At point E, the thickness had fallen to approximately ⅜".

The density of sludge dictates which type of belt should be used. The higher percent of solids in the original sludge material, the bigger openings may be used in the belt, which allows the use of a belt having a higher capacity. For example, in reference to the previously-discussed Ashworth manual, an A4 belt is used for a higher density sludge than an A5 belt.

It should be understood that other belts may be used instead of the particular belts disclosed while remaining within the spirit and scope of the present invention. For example, a wire mesh belt could be used which is composed of a plurality of interwoven wire strands having a circular cross section, if it is found that the belt can effectively drag the sludge across the channel floor 14 and heated plate 15. Instead of applying extra heat to the sludge, it is more advantageous to increase the gas burner length in order to reduce the chance of flashing.

The typical linear speed of the belt 12 is approximately 33 feet per minute, which is approximately 16 revolutions per minute. This is a nominal rate, which may be varied depending on weather conditions, and the percentage of water in the sludge.

The apparatus 10 embodying the present invention has several advantages over prior art apparatus. The apparatus 10 is capable of drying a 14 weight percent solid sludge to a 40 weight percent solid sludge, as compared to the previously-discussed mechanical separation machines which produce a 30 weight percent solid product.

The initial cost and output of the the apparatus embodying the present invention is comparable to the mechanical separation devices. However, the operating costs of the apparatus embodying the present invention are much less, as much as one-third that of the mechanical devices.

Therefore it may be seen that the method and apparatus of the present invention exhibits significant advantages over the prior art. The disclosed apparatus is simple and inexpensive to operate and maintain, and is capable of producing a dried waste material which contains significant amounts of intact proteins.

We claim:

1. An apparatus for drying waste materials including a liquid, comprising:

a plate member having an upper planar surface;

a screen comprising a wall, said wall defining a hole extending through said screen, said screen being in sliding contact with said upper planar surface of said plate member such that said wall and said planar surface combine to define an upwardly disposed cavity to receive waste;

means for disposing said waste into said cavity;

means for advancing said screen and the hole therein in a path along said upper planar surface such that a portion of said waste received in the cavity is dragged across said plate member; and means for heating said plate member such that said liquid is separated from said waste by evaporation.

2. The apparatus of claim 1 wherein said plate member is substantially horizontal.

3. The apparatus of claim 1 further comprising means for removing said waste from said cavity.

4. The apparatus of claim 1 wherein said wall defined by said screen is a continuous wall defining said hole.

5. The apparatus of claim 1 wherein said wall is a front wall, and wherein said screen further comprises a rear wall and two side walls, and wherein said front wall, said rear wall, and said side walls combine to define said hole.

6. The apparatus of claim 1 wherein said wall is a front wall, and wherein said screen further comprises a rear wall and two side walls, and wherein said front wall, said rear wall, said side walls, and said upper planar surface define said cavity.

7. The apparatus of claim 1 wherein said wall is a front wall, and wherein said screen further comprises a rear wall and two side walls, and wherein said front wall, said rear wall, said side walls, and said upper planar surface, in combination, define said cavity.

8. An apparatus for drying waste materials including a liquid, comprising:

a plate member having an upper planar surface;

an endless screen belt comprising a wall, said wall defining a hole extending through said screen, a portion of said belt being in sliding contact with said upper planar surface of said plate member such that said wall and said planar surface combine to define an upwardly disposed cavity to receive waste;

means for disposing said waste into said cavity;

means for advancing said screen belt and the hole therein in an endless path along said upper planar surface such that a portion of said waste received in the cavity is dragged across said plate member; and means for heating said plate member such that said liquid is separated from said waste by evaporation.

9. A method of removing water from a waste material having a solid waste component and a liquid water component, comprising the steps of:

disposing said waste material into a layer on a planar surface;

injecting air into said layer such that said waste material floats to the top of said layer, leaving said liquid water at the bottom of said layer; and heating said planar surface such that said water is separated from said solid waste component as gaseous steam.

10. An apparatus for drying waste materials including a liquid, comprising:

a plate member having an upper planar surface;

a screen defining at least one hole extending through said screen, said screen being in sliding contact with said upper planar surface of said plate member;

means for disposing said waste onto said belt such that a portion of said waste passes through said hole and contacts said upper planar surface of said plate;

means for advancing said screen and said hole in a path along said upper planar surface such that said portion of said waste is dragged across said plate; and means for heating said plate member such that said liquid is separated from said waste by evaporation.

11. The apparatus of claim 10 wherein said screen is an endless screen belt, and further comprising:

a cylindrical roller supporting said screen; and a tooth extending radially from said roller, said tooth extending through said hole of said screen when said hole passes over said roller, such that said hole is cleared of dried waste.

12. The apparatus of claim 11 wherein said tooth substantially conforms to said hole.

13. An apparatus for drying waste materials including a liquid, comprising:

a plate member having an upper planar surface;

an endless screen belt defining a plurality of holes extending through said screen, said screen being in sliding contact with said upper planar surface of said plate member;

a plurality of rollers including a first roller, said rollers supporting said screen;

means for disposing said waste onto a portion of said belt in contact with said plate such that a portion of said waste passes through said holes and contacts said upper planar surface of said plate;

means for rotating said rollers such that said screen belt passes along a path along said upper planar surface and such that said portion of said waste is dragged across said plate;

means for heating said plate member such that said liquid is separated from said waste by evaporation and escapes as vapor;

a plurality of teeth radially extending from said first roller, said teeth configured to fit within corresponding holes in said screen when said holes pass over said roller, such that teeth push dried waste from within said holes; and heat exchanger means for capturing said vapor and transferring heat from said steam to said waste prior to disposing said waste onto said belt.

14. A method of drying waste material having a water content, comprising the steps of:

dragging a screen in a path across a flat plate;

disposing said waste material upon said screen such that said waste material is dragged along said plate by said screen; and heating said plate such that a portion of said water evaporates from said waste material and escapes as steam.

15. A method for drying a sludge having a solid waste component and a liquid water component, comprising the steps of:

dragging a screen in a path across a flat plate;

disposing said sludge into a layer upon said screen such that said sludge is dragged along said plate by said screen;

injecting air into said sludge layer such that said waste material floats to the top of said layer, leaving said liquid water at the bottom of said layer; and heating said planar surface such that said water is separated from said solid waste component as gaseous steam.

16. The method for drying said sludge as claimed in claim 15, wherein said injected air is heated.

17. The method for drying said sludge as claimed in claim 16, further comprising the step of capturing said steam and passing said steam through a heat exchanger to assist in heating said injected air.

18. The method for drying sludge as claimed in claim 15, wherein said air is injected into said sludge layer at an angle of at least 10 degrees relative to the planar surface of said plate.

19. The method for drying sludge as claimed in claim 15, wherein said air is injected into said sludge layer at an angle substantially normal to the planar surface of said plate.

20. The method of drying sludge as claimed in claim 15, wherein said injecting step includes injecting said air in individual columns into said sludge at an angle of at least 10 degrees from the planar surface of said plate.

21. The method for drying said sludge as claimed in claim 15, wherein said injecting step includes injecting said air in individual columns into said sludge at an angle substantially normal to the planar surface of said plate.

* * * * *